US007674142B2

(12) United States Patent
Fork et al.

(10) Patent No.: US 7,674,142 B2
(45) Date of Patent: Mar. 9, 2010

(54) LATCHING STRUCTURE AND A METHOD OF MAKING AN ELECTRICAL INTERCONNECT

(75) Inventors: David K. Fork, Los Altos, CA (US); Jurgen Daniel, Mountain View, CA (US); Gordon T. Jagerson, Jr., Menlo Park, CA (US); Thomas H. Di Stefano, Monte Sereno, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 758 days.

(21) Appl. No.: 10/997,931

(22) Filed: Nov. 29, 2004

(65) Prior Publication Data

US 2006/0116010 A1 Jun. 1, 2006

(51) Int. Cl.
*H01R 4/30* (2006.01)

(52) U.S. Cl. ..... 439/859; 439/857

(58) Field of Classification Search ..... 439/859, 439/857, 856, 400, 886
See application file for complete search history.

(56) References Cited

U.S. PATENT DOCUMENTS 2,085,707 A * 6/1937 Shore ..... 439/830
2,539,230 A * 1/1951 Craig ..... 439/733.1
4,283,108 A * 8/1981 Fischer ..... 439/721
4,944,700 A * 7/1990 Simon ..... 439/801
5,662,504 A * 9/1997 Krivec ..... 439/857
5,759,061 A * 6/1998 Jensen et al. ..... 439/402
6,254,440 B1 * 7/2001 Ko et al. ..... 439/857
6,261,134 B1 * 7/2001 Muzslay ..... 439/852
6,478,604 B1 * 11/2002 Downes et al. ..... 439/400
6,641,431 B2 * 11/2003 Saitoh ..... 439/495
2006/0087064 A1 4/2006 Daniel et al.
2006/0130319 A1 6/2006 DiStefano

OTHER PUBLICATIONS

T. Hantschel et al., "Fabrication of Highly Conductive Stressed-Metal Springs and Their use as Sliding-Contact Interconnects," *Microelectronics Engineering*, 67-68, pp. 690-695, 2003.

* cited by examiner

*Primary Examiner*—Gary F. Paumen
(74) *Attorney, Agent, or Firm*—Oliff & Berridge, PLC

(57) ABSTRACT

An electrical interconnect device attaches electrical devices with a cantilever spring with out the use of solder or adhesive. The cantilever spring latches to a contact structure such that there are a plurality of contact points between the spring and the contact structure. The cantilever spring has two tines at a tip end that define an opening in the spring. The contact structure is received by the opening between the two tines so that the spring and the contact structure mate. The spring may engage the contact structure by latching to the contact structure or by a post that urges the tip end of the spring against the contact structure.

23 Claims, 13 Drawing Sheets

FIG. 9
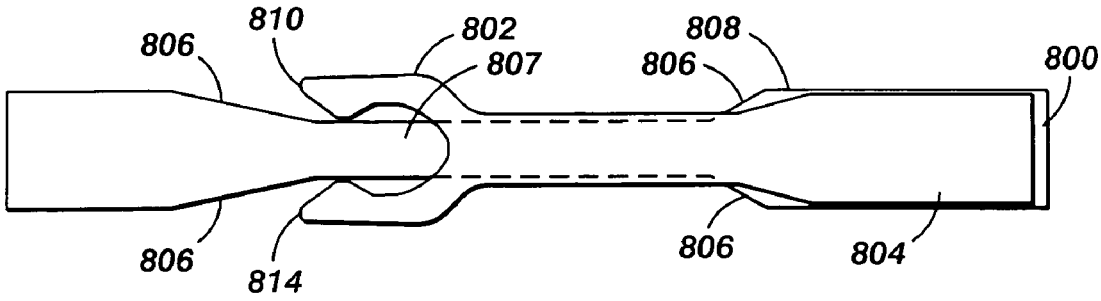
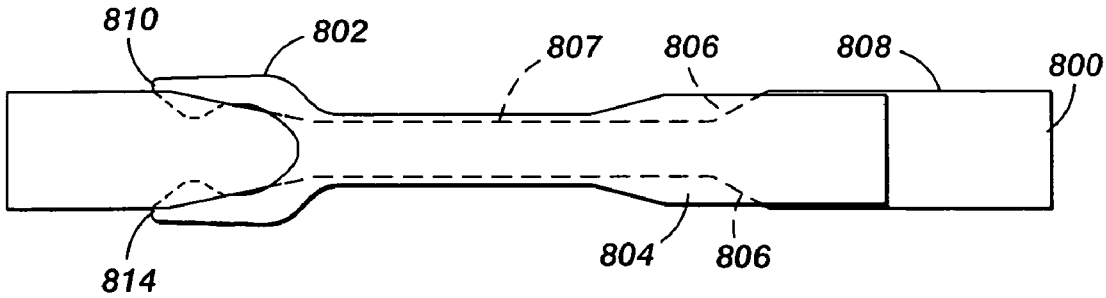
FIG. 10

FIG. 11
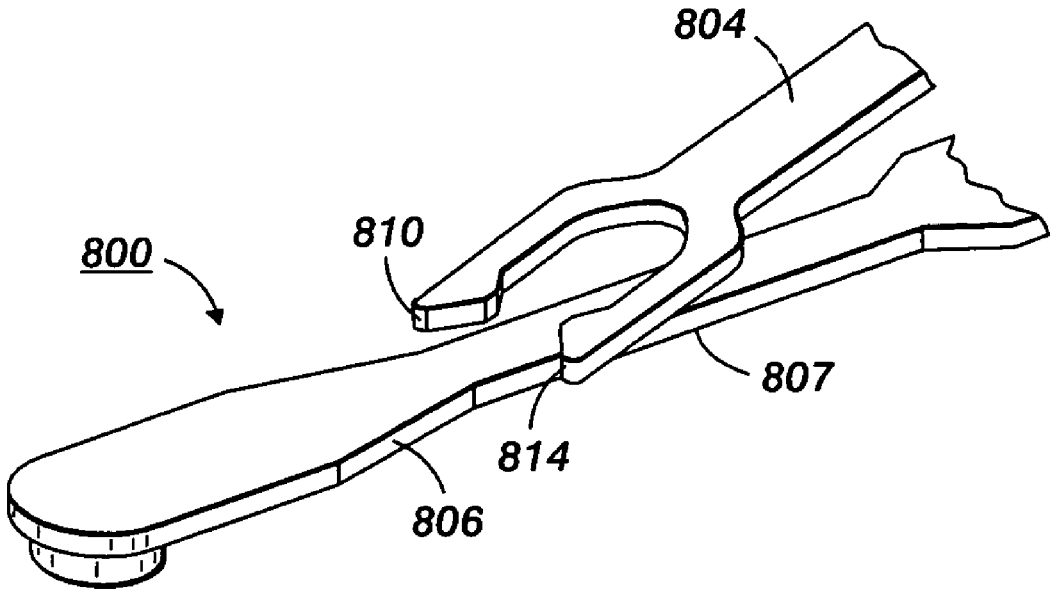
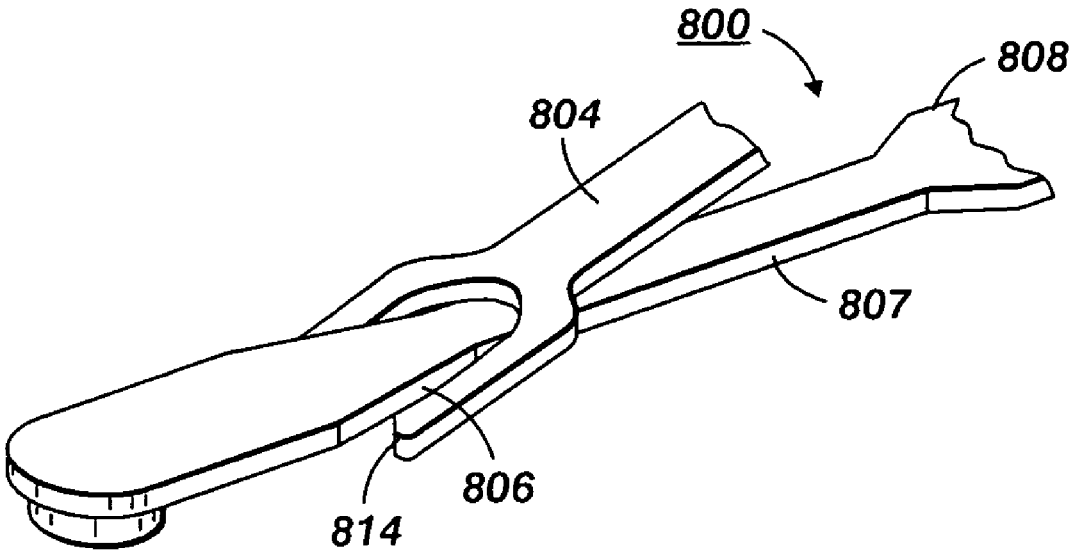
FIG. 12

FIG. 13
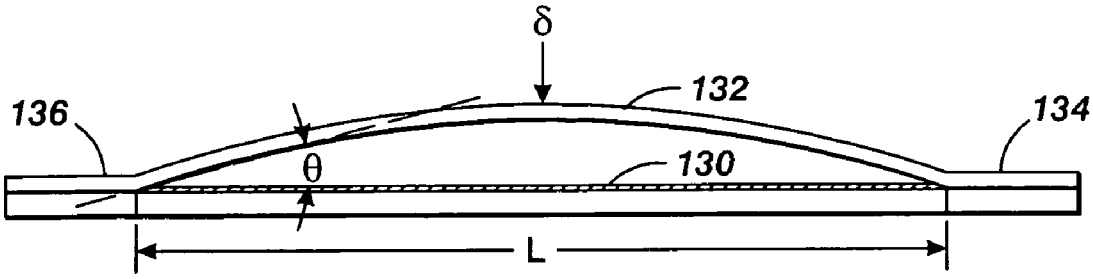
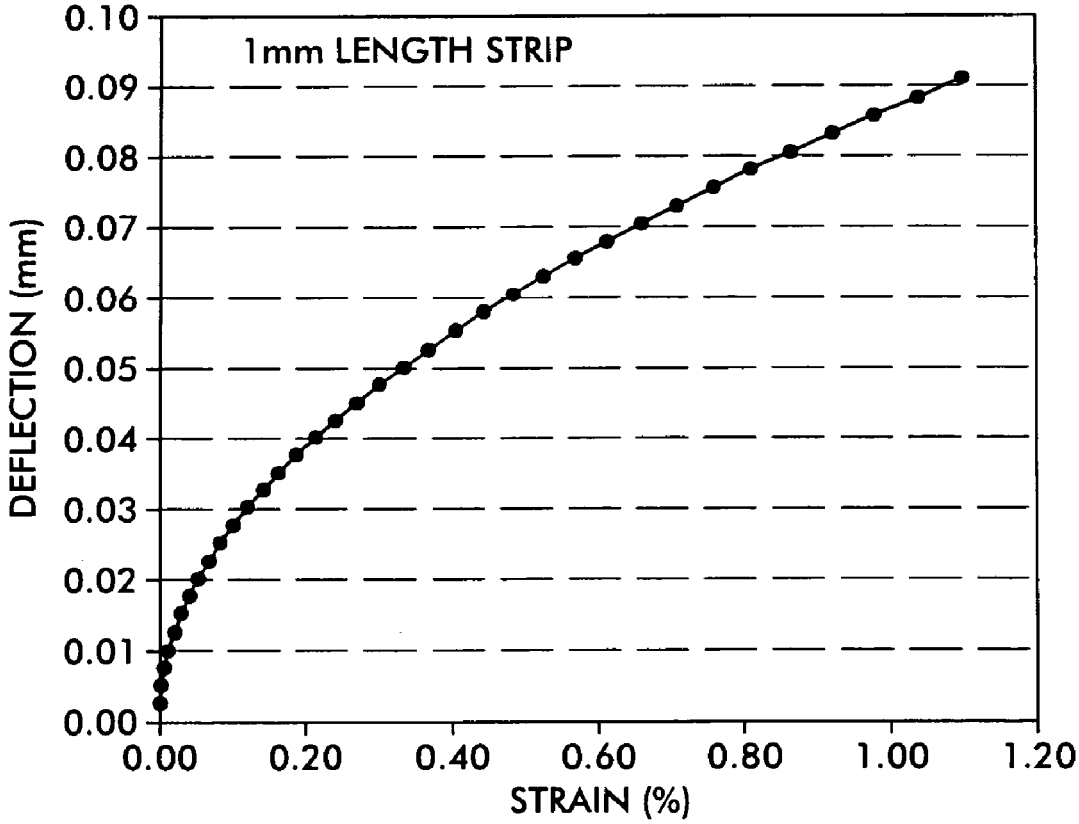
FIG. 14

LATCHING STRUCTURE AND A METHOD OF MAKING AN ELECTRICAL INTERCONNECT

BACKGROUND

An exemplary embodiment relates to mechanical latching structures, and more particularly to latching springs for an electrical interconnect.

In the related art, there are various interconnecting devices. For example, U.S. Pat. No. 6,439,898 discloses a method and apparatus for interconnecting at least two devices using an adhesive. In the related art, solder is used for electrical interconnects. In multi-chip microelectronic assemblies, solder interconnects are subject to damage and misregistration caused by heating the assembly to solder it to a substrate or circuit boars. In addition, solder typically contains lead. There is a trend in the industry to get away from using toxic substances such as lead. Thus, solder that contains silver is used as a replacement for lead solder. However, silver solder is more expensive and requires a higher temperature for processing than lead solder.

As an alternative to solder, the use of a cantilever spring, for example, with a fastening mechanism, is used to hold the interconnect together and maintain spring contact pressure. However, such a spring provides only a single point contact. A single point contact, without solder, can lead to electrical glitches when the contact moves. For example, U.S. Pat. No. 6,555,415 discloses an electronic configuration having a first surface with electrical contacts for electrical bonding. This electronic configuration requires the use of a bump for electrical bonding to form one contact.

Furthermore, conventional bent cantilever springs pop off their mating pads unless a fastening mechanism is used to hold the parts together and maintain spring contact pressure. Currently, electronic package parts are assembled using either solder to form a permanent metal joint at the spring tip or an adhesive to join a chip to the substrate. When using spring devices, the spring is either maintained under compression or a solder joint is placed at the tip of the spring. Whether the parts are assembled using solder, adhesives, or compression, they all still lack the ability for reworkability. That is, it would be difficult to detach then reattach the assembled parts for re-use.

Although a soldered part may be reworked, such would require heating the connector to melt the solder in order to disengage the attached parts. Further, some adhesives are not at all reworkable. Furthermore, once there is, for example, injection molding around a part, it can be very difficult to rework. In addition, solder free connections are highly desirable both for the elimination of lead as well as for the ability to eliminate the temperature cycle needed for reflow, and for the ability to replace individual parts of the connection.

Furthermore, interconnecting devices are a primary consideration in electronic components for high volume applications. This is particularly important in interconnection components. Another consideration is the complex process of fabrication, which entails added cost. Accordingly, a process for fabricating compliant spring contacts that is simple and that can fit in existing infrastructure is needed to simplify manufacturing and reduce cost.

Accordingly, a spring contact that mates and latches is desired. Further, a compact means of introducing multiple contact points is desired. Still further, a latching mechanism that can be disassembled is desired. With such a latching spring, parts may be engaged together and then separated, without the need for increased temperature, on several occasions, as need be, before any degradation of the contacts involved occurs.

Accordingly, there is a need for latching springs with redundant contact points for solder free electrical connection of devices. There is also a need for an interconnection designed to function through a series of connect-disconnect cycles. Furthermore, there is a need for a method for providing latching springs that is cost effective.

SUMMARY

Exemplary embodiments provide electrical interconnects, without the use of solder, that can be easily assembled at room temperature, that provide compact means of connecting multiple contact points, and that can be easily disassembled. To this end, exemplary embodiments of a compact latching spring with a plurality of contact points for solder free electrical connection are presented. The latching spring may be designed to function through a series of connect-disconnect cycles. That is, the latching spring may be disassembled and then re-assembled, for re-use.

To achieve the above-described benefits, the latching spring may be designed as a cantilever spring fabricated such that the end of the spring includes mating structures designed to latch together with structures on a corresponding mating pad.

In an exemplary embodiment, a connecting device comprises a spring with at least two tines that may latch to a contact pad with a contact post. Because the spring may latch to the contact pad, as opposed to being adhesively attached to the contact pad, the spring and the contact pad may be attached and then later detached, if desired. Also, because adhesives are not used, the connecting device may be assembled without the need to heat any of the parts of the connecting device. Such a latching structure may provide multiple contact points.

In an exemplary embodiment, a connecting device ensures a reliable contact between a cantilever spring and a mating surface. The connecting device may comprise a self aligning structure at the end of a cantilever spring and a corresponding flare structure in a mating contact. The self aligning structure may include a two tine fork at the end of the cantilever structure, with a gap or slot between the tines that is greater in width than the minimum width of the mating contact. Correspondingly, the mating contact may be a strip of metal with a flare at the far end or may simply be a pad with a post to connect the spring to the pad. In normal operation, the contact spring is positioned above the mating contact, in alignment with the mating contact.

In an exemplary embodiment, an electrical interconnect device has a spring having a base end and a tip extending from the base end, wherein the tip has an opening defining at least two tines, and a stop and a pinch point further defining the opening in the spring. The at least two tines are free to move in a direction about perpendicular to a plane of the at least two tines.

In an exemplary embodiment, the electrical interconnect further has a contact structure received by the opening between the at least two tines, a spring having a base end and a tip extending from the base end, the tip having an opening defining at least two tines, and a contact structure received by the opening between the at least two tines. The at least two tines may move in a direction about perpendicular to a plane of the at least two tines to engage the contact structure. The base end of the spring may be anchored to a substrate.

In an exemplary embodiment, the spring between the stop and the pinch point is in contact with the contact structure, and the tip of the spring is also in contact with the contact structure.

In an exemplary embodiment, the electrical interconnect further has at least one pinch point in proximity to an end of the tip of the spring, opposite the base end, serving as a latching mechanism, and at least one stop on the tip of the spring wherein the contact structure received by the opening between the at least two tines is inserted between the at least two tines, past the pinch point, and is limited by the stop. The contact structure may have a base, a stem and a head, wherein the stem has a width smaller than a width of the base and a width of the head. A surface of the spring may be treated with a passivating metal or a cold welding metal.

In an exemplary embodiment, the at least two tines are free to move such that the tip is about perpendicular to a plane at the stop of the at least two tines.

In an exemplary embodiment, the at least two tines are free to move in a direction about perpendicular to a plane of the at least two tines, and are free to substantially resume a direction about parallel to a plane of at least the two tines.

In an exemplary embodiment, the electrical interconnect further has a plurality of contact points between the tip of the spring and the contact structure, wherein there are at least six contact points between the tip of the spring and the contact structure.

In an exemplary embodiment, a spring contact structure and a mating contact include at least two tines each having an end and a center region, the at least two tines being at a tip end of the spring contact structure, the at least two tines arranged with one tine at each side of the mating contact, the end of each of the at least two tines being in contact with the mating contact while the center region of each of the at least two tines is in contact with the mating contact, and a spacing between the two tines, wherein the spacing is greater in width than a minimum width of the mating contact. The mating contact may be shaped as a strip and may have a width smaller than the spacing between the two tines.

In an exemplary embodiment, the spring contact structure and the mating contact further include a flare at a distal end of the mating contact such that a maximum width of the flare is larger than the spacing between the tines of the spring contact structure.

In an exemplary embodiment, a method of latching a spring having two tines to a contact structure includes urging the spring into contact with a top surface, a bottom surface, or opposite sides of the contact structure, and engaging the two tines of the spring with the contact structure the two tines moving in a direction about perpendicular to a plane of the two tines.

In an exemplary embodiment, the method of latching a spring having two tines to a contact structure further includes engaging the two tines at a bottom edge of the contact structure, on either side of the contact structure, when the spring is further biased toward the mating contact.

In an exemplary embodiment, the method of latching a spring having two tines to a contact structure further includes latching the two tines about the contact structure such that there are at least two contact points on the contact structure.

In an exemplary embodiment, the method of latching a spring having two tines to a contact structure further includes latching the two tines of the spring to a post wherein the post urges the spring against the contact structure, and engaging the contact structure with the spring due to a force from the post to a tip of the spring. There may be at least 6 contact points between the spring, the post and the contact structure, and the contact structure may be a lead frame.

BRIEF DESCRIPTION OF THE DRAWINGS

FIG. 9 is a plan view of a latching device in an exemplary embodiment.

FIG. 10 is a plan view of a latching device in an exemplary embodiment.

FIG. 11 is an isometric view of a latching device before engagement in an exemplary embodiment.

FIG. 12 is an isometric view of a latching device after engagement in an exemplary embodiment.

FIG. 13 illustrates a structural model of a spring spanning to points of support in an exemplary embodiment.

FIG. 14 is a chart of plotted values of the percent strain versus the deflection of the spring of the structural model illustrated in FIG. 13 in an exemplary embodiment.

DETAILED DESCRIPTION OF EMBODIMENTS

Exemplary embodiments include a cantilever latching spring, fabricated such that an end of the spring includes mating structures designed to latch together with structures on a corresponding mating pad.

In an exemplary embodiment, a spring with a specially designed latching tip structure is illustrated such that the spring and a contact pad are in sliding contact motion. In other words, the spring with the specially designed latching structure is designed to scrub out against a contact pad and latch itself to a mating structure, for example, a contact post. This scrubbing may push away debris and contamination from the contact pad.

Figure 1:
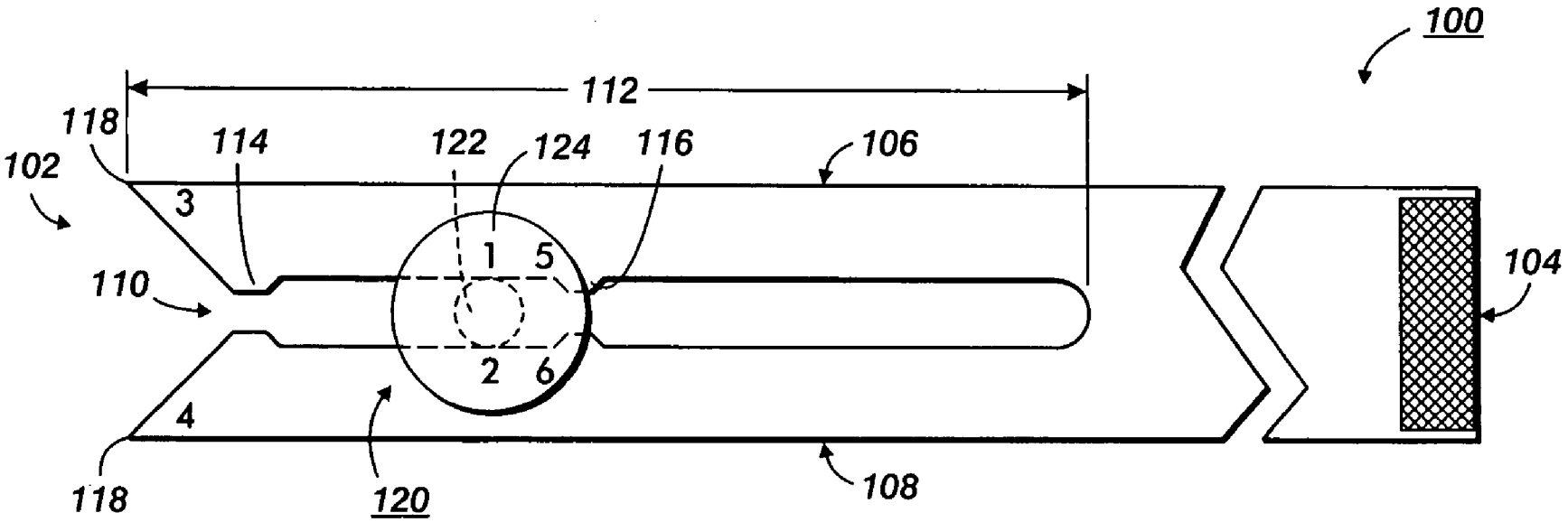
FIG. 1 is a plan view of a cantilever spring latching device in an exemplary embodiment.
Figure 2A:
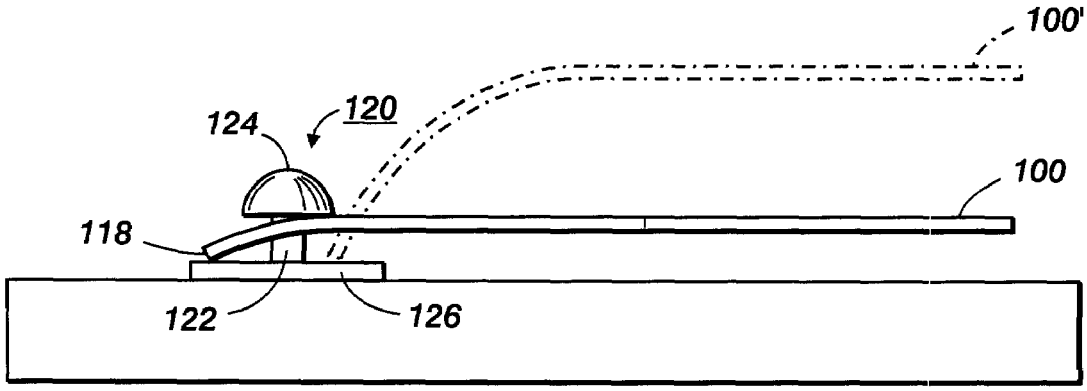
FIGS. 2A and 2B are side views of a cantilever spring latching device in two different exemplary embodiments.
Figure 2B:
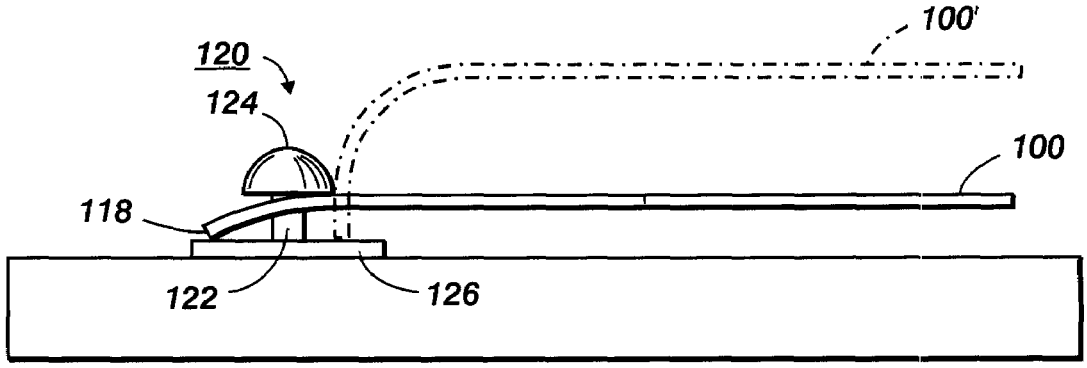

Referring to FIGS. 1, 2A and 2B, a cantilever spring 100, 100' has a first end 102 and a second end 104. The second end 104 may be anchored to a substrate upon which the spring 100, 100' is fabricated. The cantilever spring 100, 100' has two tines 106, 108 that may define a slot 110 in the cantilever spring 100, 100'. The slot 110 may extend from the first end 102 of the cantilever spring 100, 100' to a distance 112 through the spring 100, 100'. The slot 110 may have a larger diameter at the first end 102 and may taper to a smaller diameter at a pinch point 114. The slot 110 may also have a larger diameter on either side of the pinch point 114. The slot 110 may further extend, at substantially the same diameter, from the pinch point 114 to a stop 116. The slot 110 may have a larger diameter on either side of the stop 116. Thus, the pinch point 114 and the stop 116 may be distinguishable by a narrowing of the slot 110 in the spring 100, 100'. Each of the tines 106, 108 may have a protruding tip 118.

The cantilever spring 100 may latch about a contact post 120. The contact post 120 may be located in the slot 110 between the pinch point 114 and the stop 116. The contact post 120 may have a stem 122 with a diameter equal to or less than the diameter of the slot 110 between the pinch point 114 and the stop 116, such that the stem 122 may fit in the slot 110 between the tines 106, 108. The contact post 120 may also have a head 124 larger in diameter than the stem 122 and larger in diameter than the slot 110 between the pinch point 114 and the stop 116. The pinch point 114 may produce a latching effect, i.e., once the contact post 120 slides past the pinch point 114, the contact post 120 may be prevented from returning through the pinch point 114 without an external force to separate the parts. The contact post 120 may either slide within the slot 110 between the pinch point 114 and the stop 116 (as illustrated) or may become fixed.

Referring to FIGS. 2A and 2B, the natural scrubbing action of the spring 100 while it is compressed is a mechanism that may drive the latching spring protruding tip 118 into the contact post 120. Vertical compression during part placement may result in the lateral translation of the protruding tip 118. The cantilever spring 100, 100' may be released to an initial angle of, for example, about 60 degrees, enabling the protruding tip 118 to flatten and scrub away from the base, i.e., anchored second end 104, during compression. This may allow for the orientation of multiple latching springs on a substrate, each possibly having arbitrary orientations. Regardless of orientation, the protruding tips 118 scrub laterally away from their bases.

The protruding tip 118 features a preferred V-shaped structure that may be designed to cause the tip 118 to find and center itself to the stem 122 of the contact post 120 as the spring 100 is scrubbing out against a contact pad 126. When aligning the cantilever spring 100, the contact post 120 and protruding tip 118 may be aligned sufficiently so that the contact post 120 may be placed between points 3 and 4, as illustrated in FIG. 1. During compression, the V-shape structure of the protruding tip 118 may self align the cantilever spring 100 to the contact post 120.

As shown in FIGS. 1, 2A and 2B, the contact post 120 may have a mushroom cap-like shape head 124 built into the structure of the contact post 120. The mushroom cap-like shape may retain the cantilever spring 100, 100' to keep the spring 100, 100' pressed against the contact pad 126 of a substrate 128, and to keep the spring 100, 100' in contact with the contact post 120.

The structure illustrated in FIGS. 1 2A and 2B may make at least six separate electrical contacts. Points 3 and 4 may make contact with a contact surface of the contact pad 126. At points 1 and 2, inside edges of the slot 110 may make contact with the sides of the contact post 120. Also, at points 5 and 6, the surface of the cantilever spring 100, 100' may make contact with the head 124 of the contact post 120.

The local spring deflections occurring at the tip 118 of the cantilever spring 100 may involve much higher forces than what would normally be produced simply by compressing a long bent cantilever spring. This occurs because the elements that flex at the protruding tip 118 may be much stiffer because of their smaller dimension and direction of flexure, as quantified in numerical examples given below. In particular, because of the lateral flexure, produced when the tines 106, 108 are splayed apart to accommodate the contact post 120, an effective thickness of the cantilever spring 100 is a width of the tine, not the width of the cantilever spring 100, and cantilever thickness has a cubic effect on spring constant.

EXAMPLE

A spring design was modeled using simple expressions for elastic beam flexure. The model parameters and results are summarized below in Table 1. The aspect ratios of the features in the model are comparable to FIG. 2. The estimates of the contact force were made using the expression for the spring constant k of the cantilever beam, $K=Ywt^3/4l^3$; where Y=Young's modulus, w=width, t=thickness, and l=length.

TABLE 1

Numerical calculations based on latching spring design

| Input Parameters | | | Computed Properties | | |
|---|---|---|---|---|---|
| Spring Length | 1000 | μm | Vertical Spring Constant | 0.000912 | gm/μm |
| Width | 100 | μm | Vertical Force (without latch) | 0.367 | gm |
| Tine Length | 200 | μm | Vertical Strain (Max) | 0.628% | |
| Tine Width | 35 | μm | Lateral Spring Constant | 0.339352 | gm/μm |
| Latch Flexure | 5 | μm | Lateral Force | 1.697 | gm |
| Capture Length | 125 | μm | Lateral Strain | 0.656% | |
| Pinch Flexure | 15 | μm | Bending Radius | 954.9 | μm |
| Thickness | 12 | μm | Lift Height | 477.5 | μm |
| Initial Angle | 60 | deg | Compression | 402.5 | μm |
| Final Height | 75 | μm | Scrub Length | 163.0 | μm |
| Material | Nickel | | Pinch Spring Constant | 0.079084 | gm/μm |
| Material Modulus | 206.8 | Gpa | Pinch Force | 1.18626623 | gm |
| Material Density | 8.908 | gm/cc | Pinch Strain | 0.746% | |

The spring design of Example 1 uses a 1 mm long bent cantilever spring, initially lifted to an angle of 60 degrees. A compression of about 400 microns produces a scrub of about 160 microns. This is sufficient to drive the contact post past the tapered guides of the tip and the pinch point well into the latching section of the spring tip. The vertical spring constant of the long cantilever is less than 0.001 gm/micron. This is the stiffness of the spring used for conventional latch-less contacting. The lateral stiffness of the tines used at the end of the spring tip is over 300 times larger. The result is that even with much smaller flexures, the tines at the spring tip can make mechanical-electrical contact with much higher force than the long spring can make under vertical compression. In this example, about 400 microns of vertical compression generates only abut 370 mg from the spring, whereas about 5 microns of lateral flexures by the tines generates a force of 1700 mg. The peak mechanical strain in the spring metal is to be comparable for two types of flexure.

In this embodiment, the spring constant with which the tines squeeze depends on how far down the slot the contact post is inserted. The spring constant is lowest when the contact post is just passing through the pinch point. In the numerical example considered, the spring constant felt by the contact post as it passes through the pinch point is four times lower in comparison to its deep insertion point. This is advantageous, because the low spring constant allows for bumps at the pinch point that create a substantial lateral flexure, in Example 1 the pinch flexure is 15 microns. The pinch flexure may be 3 times larger than the 5 micron latch flexure, however, the strains are comparable. This is important because the pinch flexure 3 times larger than the latch flexure enables a reusable elastic flexure. That is, the latch may continue to be used through many connect-disconnect cycles. Having an appreciable size to the pinch point constriction is also important for achieving design rules with reasonable process error tolerance. In the Example, the error tolerance on the lateral dimensions is on the order of 1 micron.

Referring again to FIG. 1, the contact post 120 may be fabricated by a variety of means. The mushroom cap structure of the head 124 may be produced, for example, by plating metal up through a post mask, and allowing the plating to progress beyond the top of the mask. Referring to FIG. 3, a schematic illustration of the bump structure evolution during the plating process is illustrated.

Figure 3A:
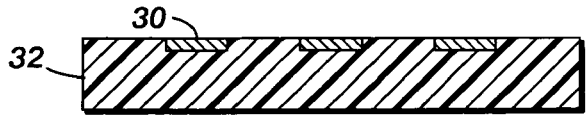
FIG. 3 is a schematic illustration of the plating process of a head of a contact post in an exemplary embodiment.
Figure 3B:
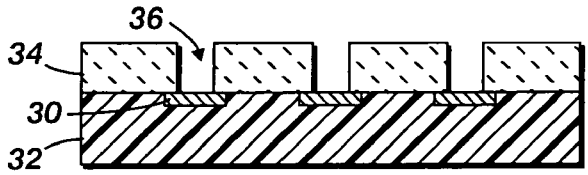
Figure 3C:
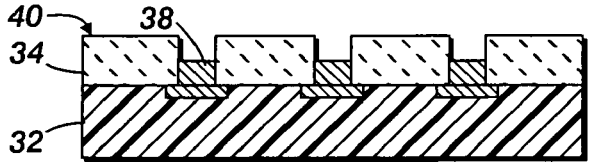
Figure 3D:
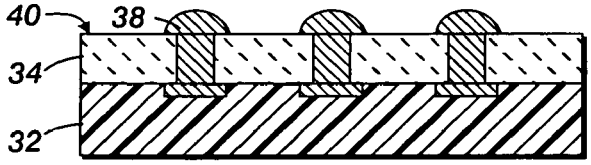
Figure 3E:
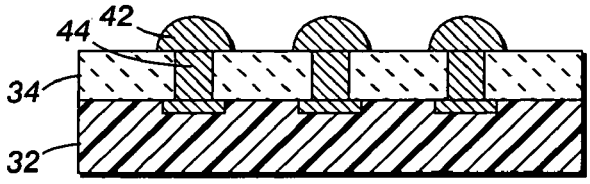
Figure 3F:
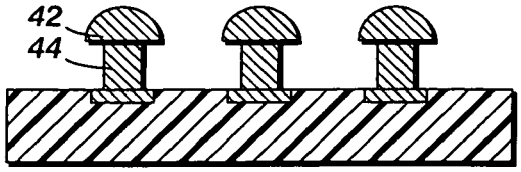

More specifically, a schematic illustration of the creation of a post structure with a mushroom cap is shown. Here, six progressive steps are illustrated in the fabrication of the contact post structure. In particular, FIG. 3A illustrates a set of metal pads 30 arrayed on a substrate 32. As shown at FIG. 3B, photolithography is used to define a layer of resist 34 with a pattern in the resist 34. The pattern consists of cylindrical holes 36 in the resist 34. In FIG. 3C, a metal 38 is electroplated up through a portion of the resist 34 and the cylindrical holes 36 are shown partially filed with the metal 38. Referring to FIG. 3D, as the electroplating process continues, the metal 38 reaches a top surface 40 and continues to plate. Then, as the process continues, as shown in FIG. 3E, a dome or cap 42 is formed over a top of a stem 44. Referring to FIG. 3F, the resist is shown stripped away with only the post structure and the mushroom cap remaining, i.e., the stem 44 and the cap 42.

Figure 4:
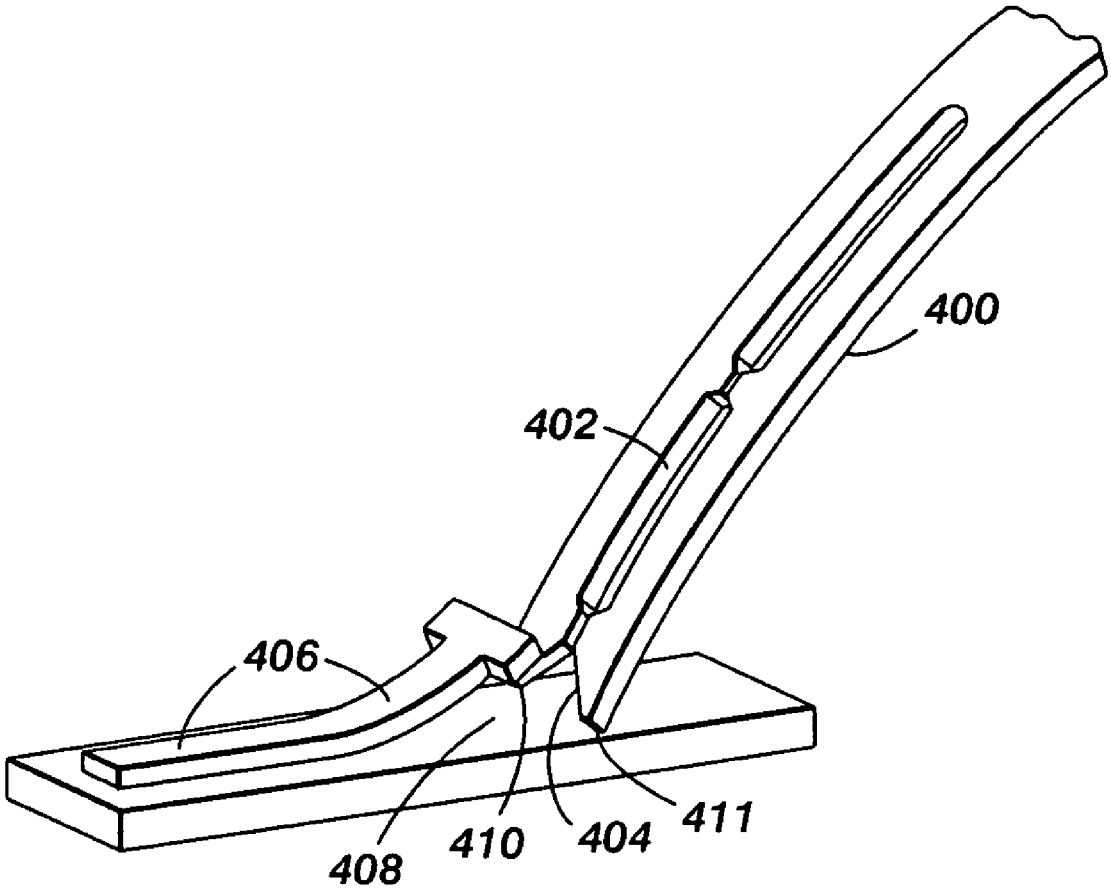
FIG. 4 is a perspective view of a latching device in an exemplary embodiment.

Referring to FIG. 4, there are many ways to create a mating post structure. One such structure may be produced using stressed metal. In such a structure, a spring 400 with a narrow insertion section 402, and a larger structure at the tip may be designed to replace the contact post-with-cap structure illustrated in FIG. 1. Such a structure, without the need for electroplating up through a thick layer of resist, is illustrated in FIG. 4.

FIG. 4 illustrates a latching spring tip 404 approaching a bent cantilever post 406. In an exemplary embodiment, the spring 100 is made of metal. The metal may be a resilient material with a thin coating of oxidation resistant metal such as gold, or, for example, nickel alloy, phosphor bronze, beryllium copper, tungsten, molybdenum, chrome or their alloys, and the like. A conducting contact region 408 under the bent cantilever post 406 may provide two points of electrical contact 410, 411 to the latching tip. Four other points of contact may be made directly to the bent cantilever post 406. Mating surfaces of this illustrated latching mechanism may be coated with material to improve resistance to oxidation, such as gold. Other desirable features to coating the illustrated latching mechanism are conductivity and lubricity. In the event that the contact operates without fretting and does not undergo extensive contact cycling, the coating materials may be cold welded together. Fretting is the wear occurring at an electrical contact that undergoes sliding motion. Contact cycling is the making and breaking of a reusable electrical contact.

Figure 5:
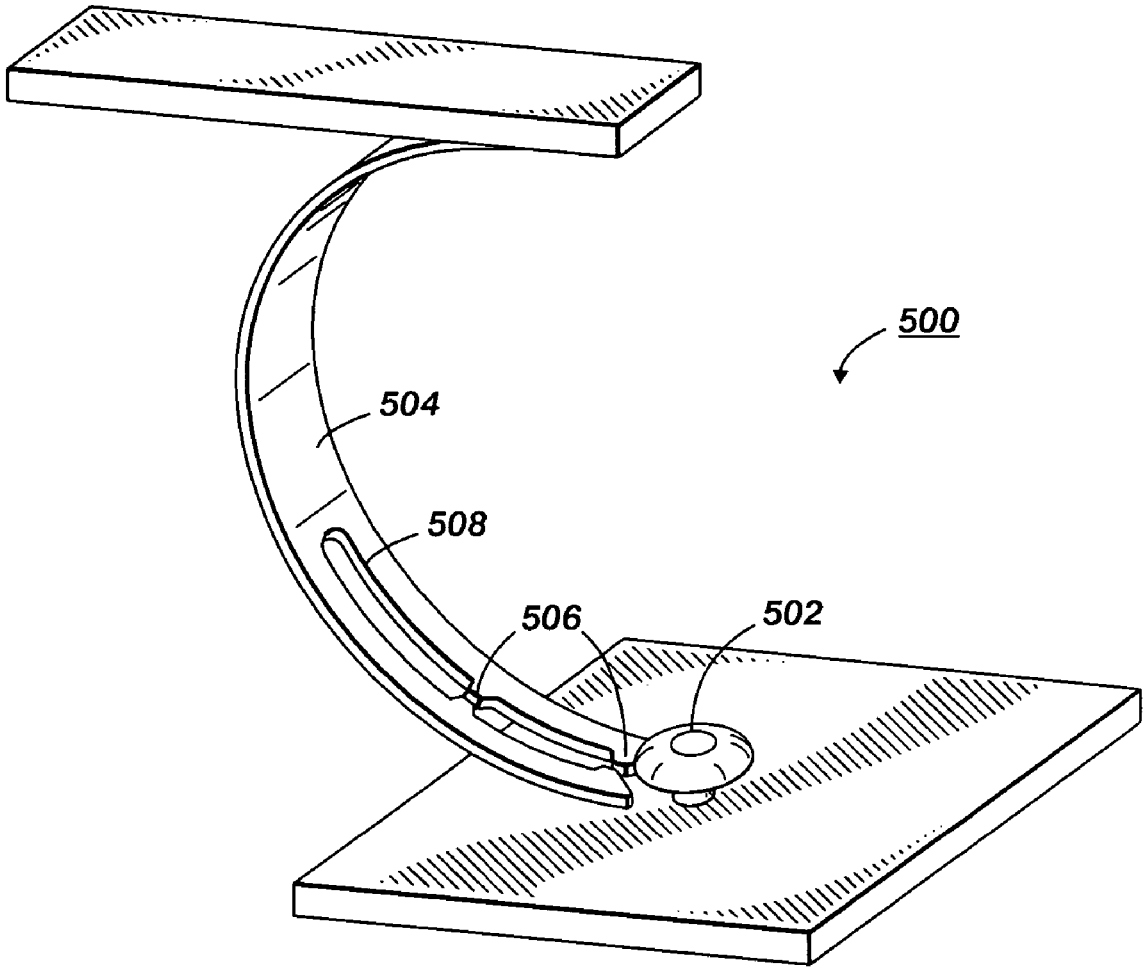
FIG. 5 is a perspective view of a latching device in an exemplary embodiment.

One consideration regarding using vertical compression to push the spring tip into the contact post is that the bent cantilever springs lose much of their lateral compliance when flattened. Referring to FIG. 5, in an exemplary embodiment, one alternative is to assemble a latch 500 to a post 502 by sliding the parts together without compression, leaving a bent cantilever spring 504 at a higher lift angle with more lateral compliance. This may require that multiple latches face in the same direction. In contrast to using the scrub to assemble the latch, as described with reference to FIGS. 1 and 2, in sliding assembly the attack angle of the spring is constant (at least until contact is made with the contact post). A low attack-angle may be desirable if a low-profile contact is needed. One way to ensure a low attack angle at the tip is to employ springs curled to approximately 180 degrees, as illustrated in FIG. 5. The attack angle is the angle with which the tip of the spring approaches its mating contact.

Referring again to FIG. 5, in an exemplary embodiment, one variation to the latching mechanism is to provide for a fine array of pinch points 506 on an inside of a capture section 508 (slot 508). This enables the latch 500 to engage and lock at a variety of insertion depths and disable movement of the bent cantilever spring 504 from a given set point without an externally applied force. Such an assembly may prevent contact fretting and help to promote cold welding of the contact joint.

Figure 6A:
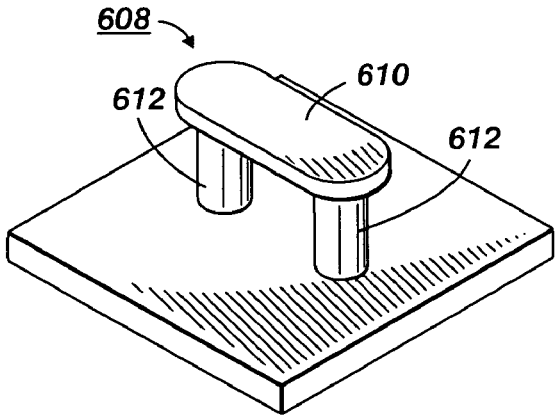
FIGS. 6A and 6B are an isometric view of a latching device in an exemplary embodiment.
Figure 6B:
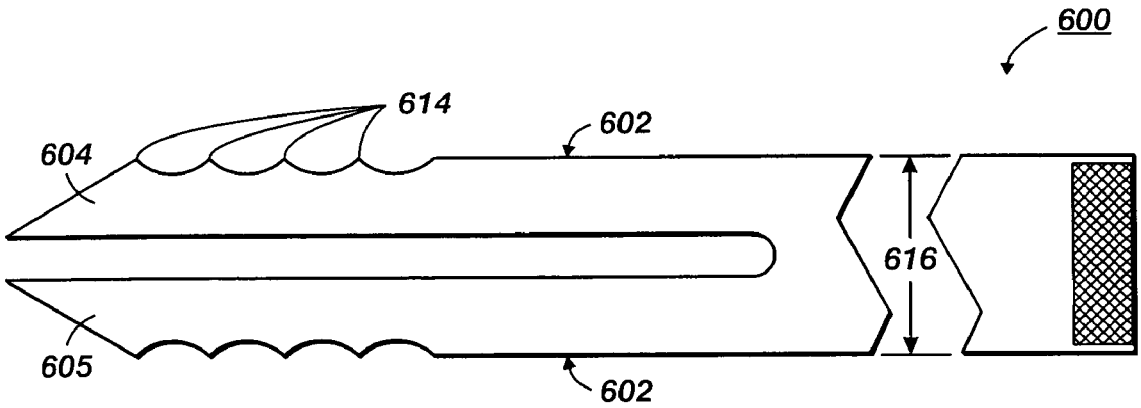

Referring to FIGS. 6A and 6B, in an exemplary embodiment, a more complex latching structure 600 with multiple tines 602 or additional springs (not shown), is illustrated. For example, a latching spring tip 604 of the spring 605 surrounded by two posts 608, rather than a post surrounded by the two tines of the spring tip (as shown in FIG. 1) is a possible variation. For example, a bridging cap 610 may connect a post pair 612. The latching spring tip 604 may also be designed to have one or more pinch points 614. In particular, the latching spring tips 604 may be staggered for higher linear density.

In an exemplary embodiment, an advantage of having a tip 604 that is wider than a rest of a released portion of the spring 605, for example, may be to optimize the lateral stiffness, and the tips 604 of spring 605 may be staggered so that they can be arrayed in a tighter linear array.

The thickness of the spring 605 relative to a width 616 of the spring 605 will need to be controlled to avoid undesirable out of plane bending actions. Further, although the springs are self-aligning, higher forces are required if the initial alignment strays too far from the ideal centerline. An alternative embodiment of the proposed double-post latch would eliminate the compliance slot, counting on a controlled amount of twisting out of plane to permit initial insertion to a chosen stop point.

Figure 7:
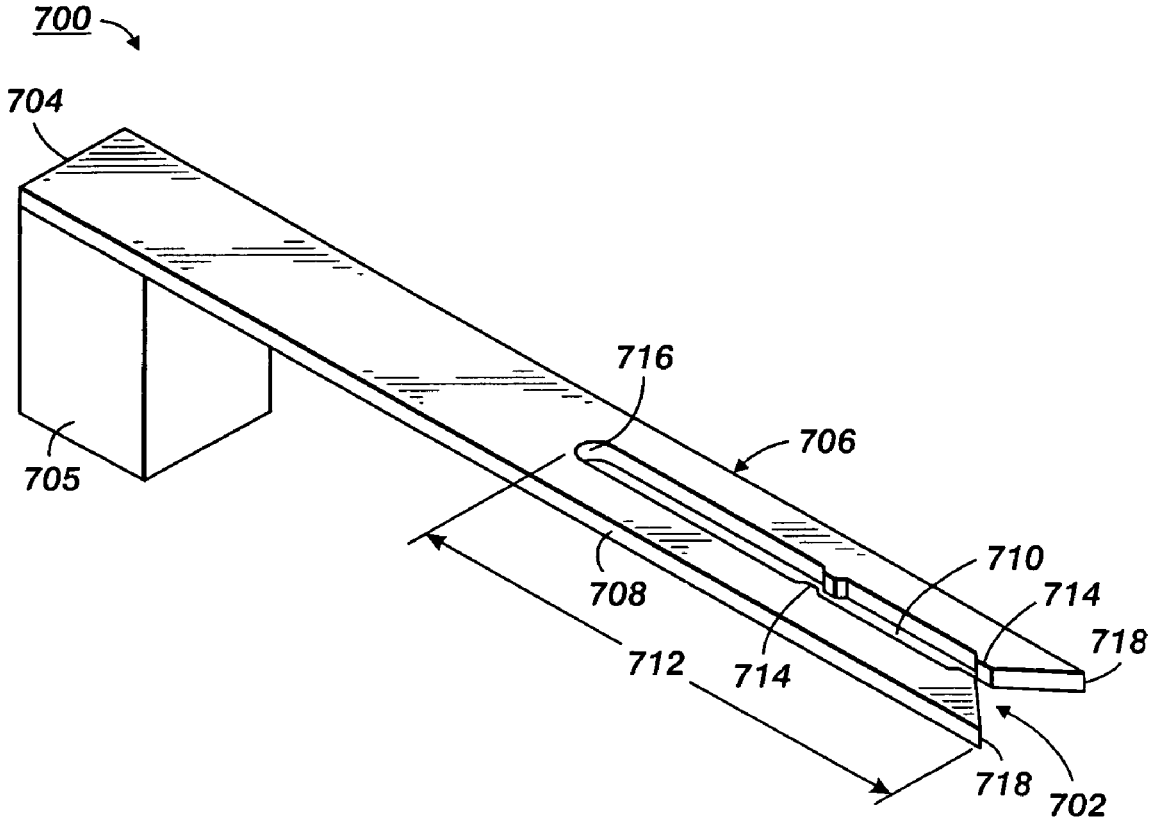
FIG. 7 is a plan view of a latching device in an exemplary embodiment.
Figure 8:
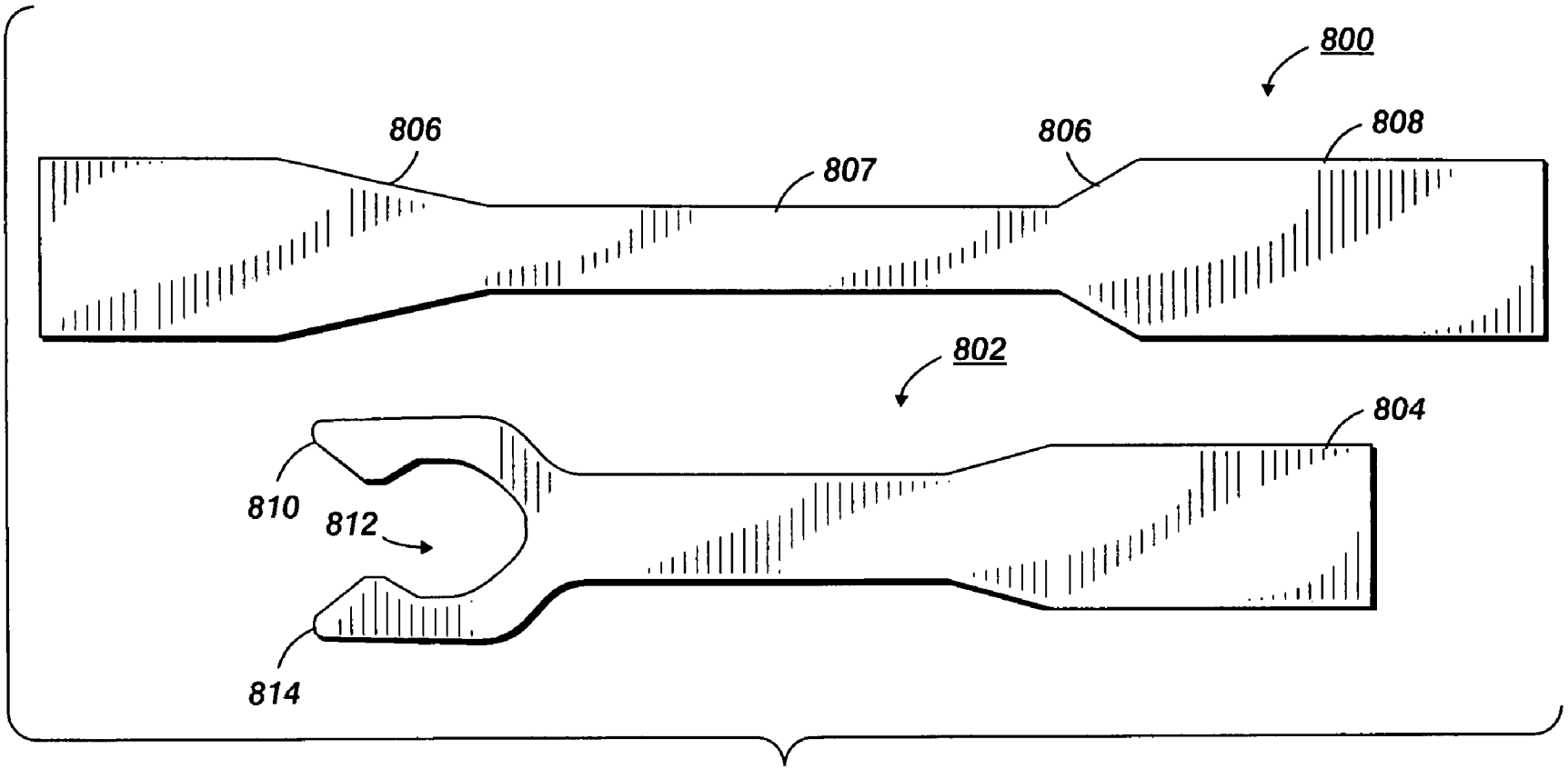
FIG. 8 is a plan view of parts of a latching device in an exemplary embodiment.

Referring to FIG. 7, in an exemplary embodiment, a cantilever spring 700 of a latching device is illustrated. The cantilever spring 700 has a first end 702 and a second end 704. The second end 704 may be anchored to a substrate 705 on which the spring 700 is fabricated. The cantilever spring 700 has two tines 706, 708 that may define a slot 710 in the cantilever spring 700. The slot 710 may extend from the first end 702 of the cantilever spring 700 to a distance 712 through the spring 700. The slot 710 may have a larger diameter at the first end 702 and may taper to a smaller diameter at a pinch point 714. The slot 710 may also have a larger diameter on either side of the pinch point 714. The slot 710 may further extend, at substantially the same diameter, from the pinch point 714 to a stop 716. The slot 710 may have a larger diameter on either side of the stop 716. Thus, the pinch point 714 and the stop 716 may be distinguishable by a narrowing of the slot 710 in the spring 700. Each of the tines 706, 708 may have a protruding tip 718. In this exemplary embodiment, the cantilever spring 700 of this latching device engages a latching structure by longitudinal translation.

When using the various embodiments of latching devices described above, alignment of the spring to the mating pad, or contact pad, is necessary. In the event the spring does not mate properly to the contact pad, the spring may slip off the contact and actually short to an adjacent contact. Furthermore, the spring may vibrate during the life of the contact causing fritting of the contact materials and degradation of the electrical resistance of the contact over time.

Referring to FIGS. 8-12, in an exemplary embodiment, a latching device 800 is illustrated in which precise alignment of the spring to the mating pad is achieved. The latching device 800 is designed with a self aligning structure 802 at the end of a cantilever spring 804 and a corresponding flare structure 806 in a mating contact 808. More specifically, the self-aligning structure 802 includes a two tine fork with tines 810 and 814 at an end of the cantilever spring 804, with a gap 812 between the tines 810 and 814. The gap 812 has a width greater than a minimum width 807 of the mating contact 808. Correspondingly, the mating contact 808 may be defined by a strip of metal with the flare 806 at the far end and/or at both ends.

Referring to FIGS. 9 and 11, when assembling the mating contact 808 and the cantilever spring 804, the cantilever spring 804 is positioned above the mating contact 808, in alignment with the mating contact 808. As illustrated, the self aligning structure 802 of the cantilever spring 804 engages the mating contact 808, such that the tines 810, 814 are brought into alignment with the minimum width 807 of the mating contact 808.

As the cantilever spring 804 and the mating contact 808 are biased together, the self aligning feature 802 slides along the mating contact 808 toward the flare 806 of the mating contact 808, as shown in FIGS. 9 and 12. The tines 810, 814 of the self aligning structure 802 move along an axis of the mating contact 808 until the self aligning structure 802 locks to the flare 806. More specifically, when the self aligning structure 802 locks to the flare 806, the tines 810, 814 underlie the flare 806 of the mating contact 808 so as to lock the cantilever spring 804 to the mating contact 808 in a vertical direction and a horizontal direction, as shown in FIG. 10.

When fully engaged, as shown in FIG. 10, the cantilever spring 804 cannot move with respect to the mating contact 808, and the cantilever spring 804 and the mating contact 808 are wedged together by the flare 806, in such a way that contact forces between the two are multiplied by an inclined plane of the flare 806.

The configuration of the latching device 800 allows for a reliable and controllable connection based on contacts on the cantilever spring 804. The self aligning structure 802 provides a robust connector that is less sensitive to misalignments and misconnects. In addition, the locking feature of the latching device 800 makes contact between the cantilever spring 804 and the mating contact 808 such that the contacts do not vibrate or rub together over time to frit the contact metal and degrade the contact. In such a configuration, vibrating is much less likely to disturb the contact and to produce spurious signals in the circuit being connected.

After the cantilever spring 804 and the mating contact 808 are latched together, the two may move together. That is, during the process of becoming latched, the self aligning structure 802 may move along the minimum width 807 area of the mating contact 808 as the cantilever spring 804 flattens out and becomes wedged on the flare 806. The cantilever spring 804 may become wedged at least one of the ends of the mating contact 808, causing a contact force on the two tines 810 and 814. Thus, there may be at least two points of contact 10 and 14. Further, the latching of the cantilever spring 804 and mating contact 808 may create a spring force that keeps the cantilever spring 804 and mating contact 808 mated together.

The minimum width 807 area of the mating contact 808 to the flare 806 area may substantially be an inclined plane. This may further multiply the force on the points of contact 10 and 14. Accordingly, to ensure high reliability electrical contact, the use of the inclined plane as a mechanical device assures high contact forces. Further, the self aligning structure 802 of the cantilever spring 804 pushes against the flare 806, therefore the points of contact at tines 810 and 814 remain under compression or spring force. The cantilever spring 804 provides a continuous force against the flare 806, even if the latching device 800 is heated and the elements move with respect to each other or expand and contract at different rates.

A method for fabricating the cantilever springs described above in the various embodiments will now be discussed below. In an exemplary embodiment, the method of making the cantilever spring uses internal stress generated within an electrodeposited film to cause the film to buckle and bow away from a supporting terminal.

Referring to FIG. 13, in an exemplary embodiment, a release layer 130 between a spring 132 and its support terminal 134 may allow the spring 132 to break away from the support terminal 134 and to take a bowed shape. The spring 132 may deform a small amount as the spring 132 is pressed against a mating contact (not shown). The release layer 130 may be simplified by using a material that releases adhesion at a set temperature. With such a thermally activated release, the spring 132 may be released from its supporting terminal 134 by simply heating the structure after fabrication. The release material may be patterned by simple, low cost methods such as stencil printing, screen printing, ink jet deposition or other printing processes.

The bowed spring 132 may provide a limited amount of compliance needed to compensate for small non-planarity of mating surfaces supporting electrical contacts. An example of an application of such contacts is in stacked IC packaging where electrical contacts on one package are pressed against mating contacts on an adjacent package in the stack. A small compliance of the spring accommodates slight imperfections and non-planarity between the two mating surfaces in order to assure good electrical contact.

A simple structural model was made in order to make calculations to describe the operation of the cantilever springs of the above described exemplary embodiments. Referring again to FIG. 13, the spring 132 may be a strip of material that spans two points of support, the supporting terminal 134 and the other support 136. The spring 132 may be free to deform and buckle between the supports 134 and 136. A compressive stress may be built into the spring 132 during its fabrication such that the spring 132 bows away from its support in order to relieve the stress. In a simplified model, the spring 132 may take the shape of a circular section (ignoring the deflection of the spring 132 at the points of contact, 134 and 136, due to the finite flexural moment of the spring member).

The deflection of the spring 132 may be due to the elongation of the spring 132 between the supports 134 and 136 at either end, where the elongating is due to a relaxation of compressive stresses built into the spring 132 during deposition. The deflection δ and the elongation ϵ are related to the angle of attachment Θ. From this, the deflection δ can be calculated as a function of the elongation ϵ of the spring 132 due to the relaxation of built in stresses. The deflection $$\delta = \frac{L\{1 - \cos\Theta\}}{2\sin\Theta}.$$

Due to an elongation of the spring member of ϵ, $$\varepsilon = \frac{L}{2\sin\Theta}\{\Theta - \sin\Theta\},$$

yielding an approximation for the maximum deflection δof the bow, $$\delta = \frac{\{3L\varepsilon\}^{\frac{1}{2}}}{2}.$$

Figure 15:
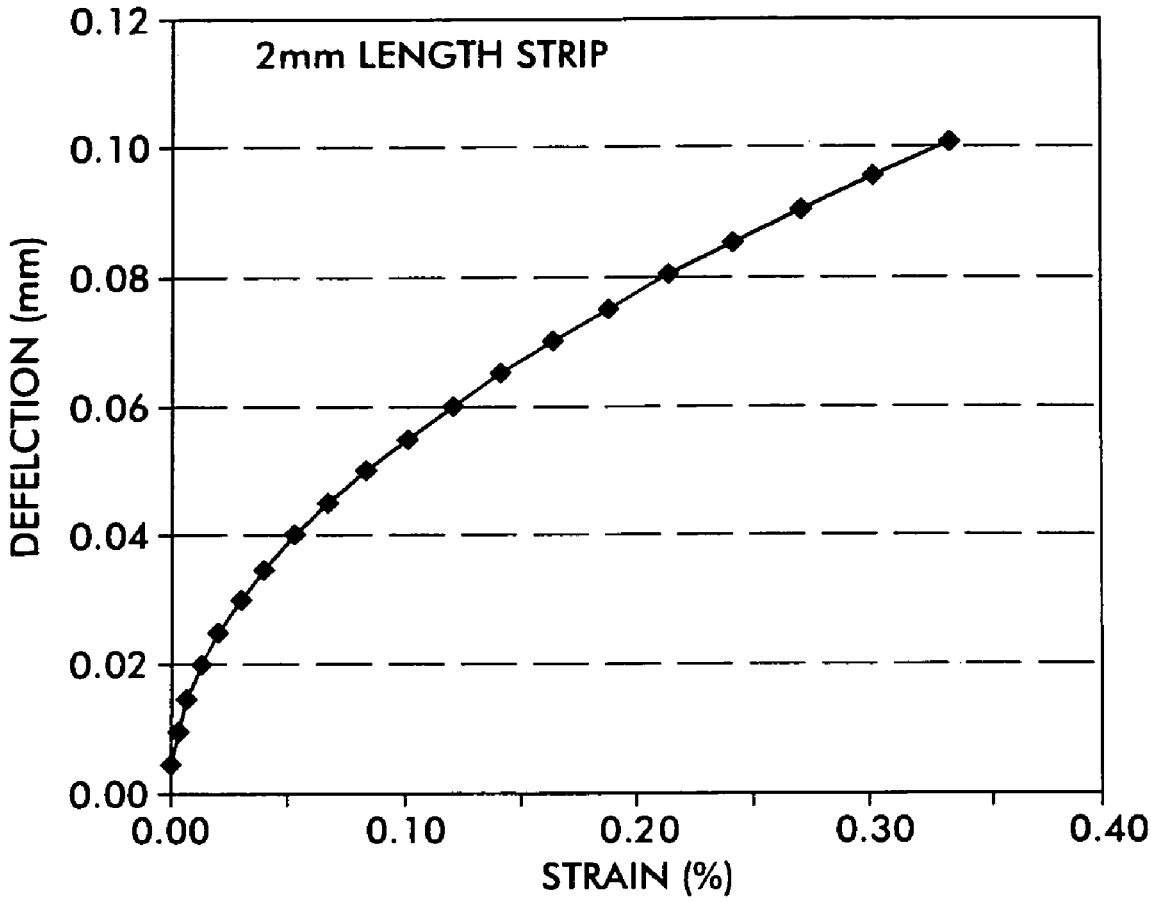
FIG. 15 is a chart of plotted values of the deflection versus the percent strain of the spring of the structural model illustrated in FIG. 13 in an exemplary embodiment.

The actual values are plotted, as shown in FIGS. 14 and 15, for calculations without approximations for several contacts of several lengths including 1 mm and 2 mm. It is seen that for these simple calculations, it is possible to achieve deflections of tens of microns (several mils), which is more than sufficient to provide contact compliance in applications such as stacked memory packages. For comparison, the total thickness of these thin packages may be about 200 μm, of which a contact compliance of 25-50 μm is adequate to accommodate non-planarity and imperfections in the package.

The spring 132 may be fabricated in a state of compressive stress by a process such as electroplating onto a surface that is heat releasable. Then the spring may be formed by heating the structure to release the adhesion and allow the spring to buckle and bow outward. The process of fabricating a metal strip under stress is known in the art of electroplating, and such stresses are often an unintended result of a plating process. In one exemplary embodiment, the intent is to fabricate the metal strip intentionally in a state of compressive stress distributed throughout the thickness of the strip. In this structure, uniformity and control of the compressive stresses throughout the thickness are not critical to the operation of the compliant spring.

Compressive stresses may be generated at relatively high levels by electroplating under certain conditions. Compressive strains of up to about 1% can be built into metal films by adjusting plating conditions, primarily impurity metal ions and plating rate. Generally, compressive stresses are increased by an increase in plating rate.

Figure 16:
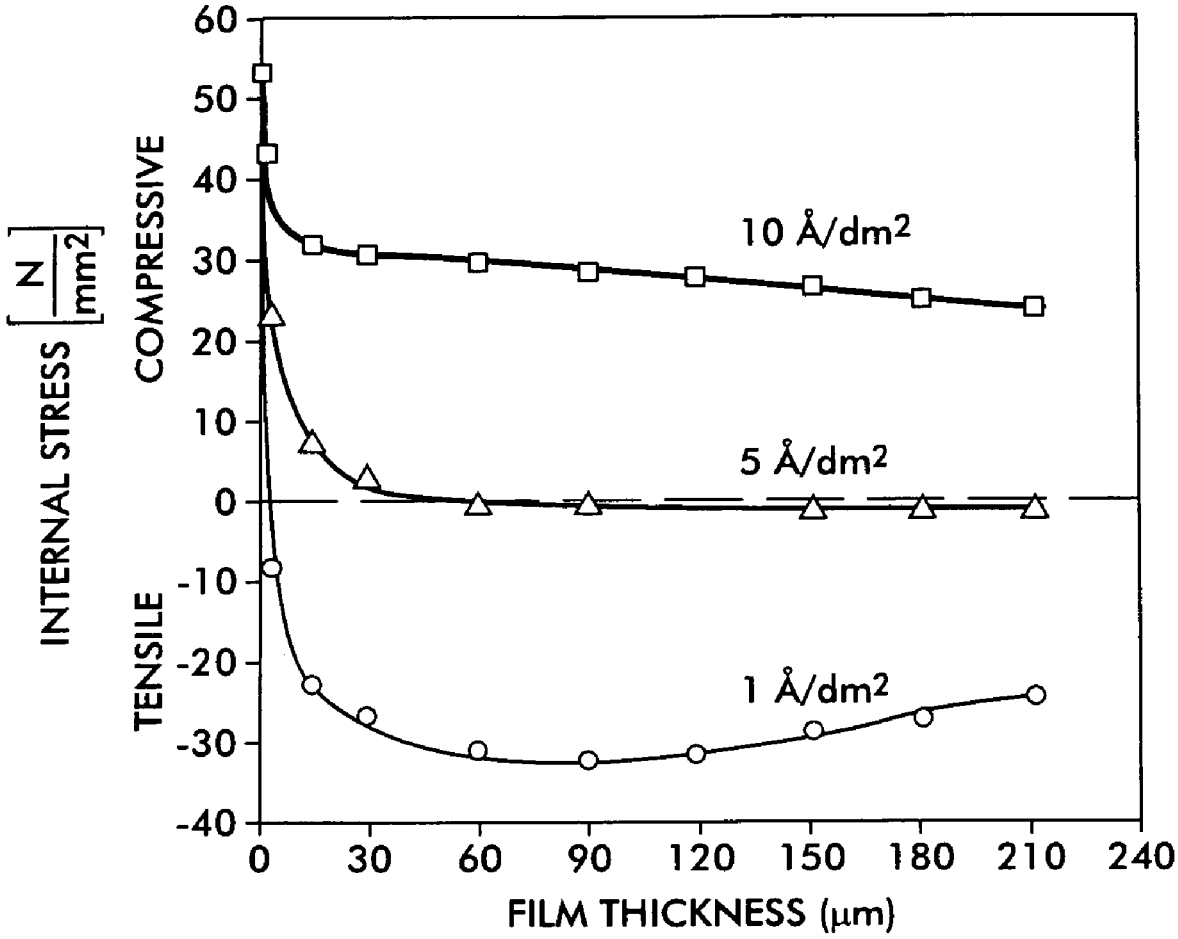
FIG. 16 is a chart of plotted values of stress as a function of film thickness for electrode position of nickel at different rates in an exemplary embodiment.

Compressive stresses such as nickel may be used for the cantilever spring. Referring now to FIG. 16, the stress in electroplated nickel films is seen to become more compressive with increasing plating current flux. Plating baths and rates are normally adjusted to minimize built in stresses. With impurities and high plating rates, the stresses can be increased to a significant fraction of the yield point.

While exemplary embodiments have been described above, it is evident that many alternatives, modifications and variations will be apparent to those skilled in the art. For example, variations of the described embodiments may involve different shapes and proportions of the main features of the described devices. Accordingly, the exemplary embodiments, as set forth above, are intended to be illustrative and not limiting. Various changes may be made without departing from the spirit and scope of the exemplary embodiments.

What is claimed is:

1. An electrical interconnect device comprising:

a spring having a base end and a tip extending from the base end, wherein the tip has an opening defining at least two tines; and a stop and a pinch point further defining the opening in the spring, wherein the at least two tines are free to move in a direction about perpendicular to a plane of the at least two tines.

2. The electrical interconnect device of claim 1, further comprising:

a contact structure received by the opening between the at least two tines.

3. The electrical interconnect device of claim 2, wherein the spring is in contact with the contact structure between the stop and the pinch point, and the tip of the spring is also in contact with the contact structure.

4. The electrical interconnect device of claim 1, wherein the at least two tines are free to move such that the tip is about perpendicular to a plane of the at least two tines at the stop of the at least two tines.

5. The electrical interconnect device of claim 1, wherein the at least two tines are free to move in a direction about perpendicular to a plane of the at least two tines, and are free to substantially resume in a direction about parallel to a plane of at least the two tines.

6. An electrical interconnect device comprising:

a spring having a base end and a tip extending from the base end, wherein the tip has an opening defining at least two tines; and a contact structure received by the opening between the at least two tines, wherein the at least two tines move in a direction about perpendicular to a plane of the at least two tines to engage the contact structure.

7. The electrical interconnect device of claim 6, wherein the base end of the spring is anchored to a substrate.

8. The electrical interconnect device of claim 6, further comprising:

at least one pinch point in proximity to an end of the tip of the spring, opposite the base end, serving as a latching mechanism.

9. The electrical interconnect device of claim 8, further comprising:

at least one stop on the tip of the spring wherein the contact structure received by the opening between the at least two tines is inserted between the at least two tines, past the pinch point, and is limited by the stop.

10. The electrical interconnect device of claim 6, wherein the contact structure has a base, a stem and a head, wherein the stem has a width smaller than a width of the base and a width of the head.

11. The electrical interconnect device of claim 6, wherein a surface of the spring is treated with a passivating metal.

12. The electrical interconnect device of claim 6, wherein a surface of the spring is treated with a cold welding metal.

13. The electrical interconnect device of claim 6, further comprising:

a plurality of contact points between the tip of the spring and the contact structure.

14. The electrical interconnect device of claim 6, wherein there are at least six contact points between the tip of the spring and the contact structure.

15. A spring contact structure and a mating contact comprising:

at least two tines each having an end and a center region, the at least two tines being at a tip end of the spring contact structure, the at least two tines arranged with one tine at each side of the mating contact, the end of each of the at least two tines being in contact with the mating contact while the center region of each of the at least two tines is in contact with the mating contact; and a spacing between the two tines, wherein the spacing is greater in width than a minimum width of the mating contact.

16. The spring contact structure and the mating contact of claim 15, wherein the mating contact is shaped as a strip and has a width smaller than the spacing between the two tines.

17. The spring contact structure and the mating contact of claim 15, wherein the mating contact comprises:

a flare at a distal end of the mating contact such that a maximum width of the flare is larger than the spacing between the tines of the spring contact structure.

18. A method of latching a spring having two tines to a contact structure, the method comprising:

urging the spring into contact with a top surface, a bottom surface, or opposite sides of the contact structure; and engaging the two tines of the spring with the contact structure the two tines moving in a direction about perpendicular to a plane of the two tines.

19. The method of claim 18, further comprising:

engaging the two tines at a bottom edge of the contact structure, on either side of the contact structure, when the spring is further biased toward the mating contact.

20. The method of claim 18, further comprising:

latching the two tines about the contact structure such that there are at least two contact points on the contact structure.

21. The method of claim 18, further comprising:

latching the two tines of the spring to a post wherein the post urges the spring against the contact structure; and engaging the contact structure with the spring due to a force from the post to a tip of the spring.

22. The method of claim 21, wherein there are at least 6 contact points between the spring, the post and the contact structure.

23. The method of claim 18, wherein the contact structure is a lead frame.

* * * * *